US008393619B2

(12) United States Patent
Iwamoto

(10) Patent No.: US 8,393,619 B2
(45) Date of Patent: Mar. 12, 2013

(54) IMAGE FORMING APPARATUS

(75) Inventor: Tsuyoshi Iwamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/406,636

(22) Filed: Feb. 28, 2012

(65) Prior Publication Data

US 2012/0217699 A1 Aug. 30, 2012

(30) Foreign Application Priority Data

Feb. 28, 2011 (JP) ..... 2011-041055

(51) Int. Cl.
*B65H 9/16* (2006.01)

(52) U.S. Cl. ..... 271/251; 271/291; 271/301

(58) Field of Classification Search ..... 271/251, 271/291, 301
See application file for complete search history.

(56) References Cited

U.S. PATENT DOCUMENTS

| | | | | |
|---|---|---|---|---|
| 4,836,527 | A * | 6/1989 | Wong | 271/251 |
| 5,390,909 | A * | 2/1995 | Herrick, Jr. | 271/251 |
| 5,439,209 | A * | 8/1995 | Runzi | 271/251 |
| 6,980,766 | B2 | 12/2005 | Ito | |
| 7,571,908 | B2 * | 8/2009 | Inui et al. | 271/251 |
| 7,810,809 | B2 * | 10/2010 | Inui | 271/250 |
| 2007/0222144 | A1 * | 9/2007 | Inui et al. | 271/291 |
| 2007/0273092 | A1 * | 11/2007 | Inui | 271/251 |
| 2009/0190963 | A1 | 7/2009 | Nozawa | |
| 2010/0102504 | A1 * | 4/2010 | Yasumoto | 271/251 |
| 2010/0327520 | A1 * | 12/2010 | Inui | 271/251 |

FOREIGN PATENT DOCUMENTS

| | | | |
|---|---|---|---|
| JP | 04041353 | A * | 2/1992 |
| JP | 06199450 | A * | 7/1994 |
| JP | 11-091969 | | 4/1999 |
| JP | 2004-250174 | | 9/2004 |
| JP | 2004-294988 | | 10/2004 |
| JP | 2007-022687 | | 2/2007 |
| JP | 2009-102086 | | 5/2009 |

* cited by examiner

*Primary Examiner* — David H Bollinger
(74) *Attorney, Agent, or Firm* — Banner & Witcoff, Ltd.

(57) ABSTRACT

An image forming apparatus includes a body frame, an image forming unit and a transporting unit. The transporting unit includes a transporting tray, a side guide, a plate, a skew roller and an urging member. The transporting tray is configured to support the recording medium which is being transported. The side guide is configured to abut with an end of the recording medium in a width direction. The plate is facing the transporting tray. The skew roller is rotatably supported by the plate and is configured to skew the recording medium toward the side guide. The urging member is configured to urge a portion of the plate toward the transporting tray.

11 Claims, 6 Drawing Sheets

IMAGE FORMING APPARATUS

CROSS REFERENCE TO RELATED APPLICATION

The present application claims priority from Japanese Patent Application No. 2011-041055, which was filed on Feb. 28, 2011, the disclosure of which is incorporated herein by reference in its entirety.

BACKGROUND

1. Technical Field

Aspects of the invention relate to an image forming apparatus configured to transport a sheet-type recording medium.

2. Related Art

An image forming apparatus including a skew roller and a guide member configured to transport paper (a recording medium) while bringing the paper into abutment with a reference surface provided on one side in a paper width direction to align the paper on the one side (so-called side registration) provided in the interior thereof is known. The guide member is provided along a paper transporting direction at an end portion on the one side in the paper width direction. The skew roller is provided so that a rotating center shaft thereof extends obliquely with respect to the paper width direction and is configured to transport the paper in the paper transporting direction while skewing the paper toward the guide member.

In the apparatus of this type, as described in respective publications shown below, in convenience of simplification of the configuration and space of the arrangement, the skew roller may be provided in the vicinity of the guide member and supported in a cantilevered structure from the outside with respect to the guide member in the paper width direction. Such a configuration is employed in many cases when so-called a double-sided printing tray (re-transporting unit) used for performing image formation on both surfaces of the paper is configured to be demountably mounted with respect to a body portion of the image forming apparatus.

Here, in the configuration as described above, the side registration transport of the paper is performed desirably by the skew roller being supported desirably.

SUMMARY

A need has arisen to provide an image forming apparatus configured to perform a side registration transport of a recording medium (paper) more stably with a more simple apparatus configuration.

Aspects of an invention provide an image forming apparatus including a body frame, an image forming unit and a transporting unit. The transporting unit includes a transporting tray, a side guide, a plate, a skew roller and an urging member. The transporting tray is configured to support the recording medium which is being transported. The side guide is configured to abut with an end of the recording medium in a width direction. The plate is facing the transporting tray. The skew roller is rotatably supported by the plate and is configured to skew the recording medium toward the side guide. The urging member is configured to urge a portion of the plate toward the transporting tray.

BRIEF DESCRIPTION OF THE DRAWINGS

For a more complete understanding aspects of the invention, the needs satisfied thereby, and the features and advantages thereof, reference now is made to the following descriptions taken in connection with the accompanying drawings wherein.

DESCRIPTION OF PREFERRED EMBODIMENTS

Aspects of the invention and their features and advantages may be understood by referring to FIGS. 1-6, like numerals being used for like corresponding parts in the various drawings.

<Configuration of Laser Printer>

Figure 1:
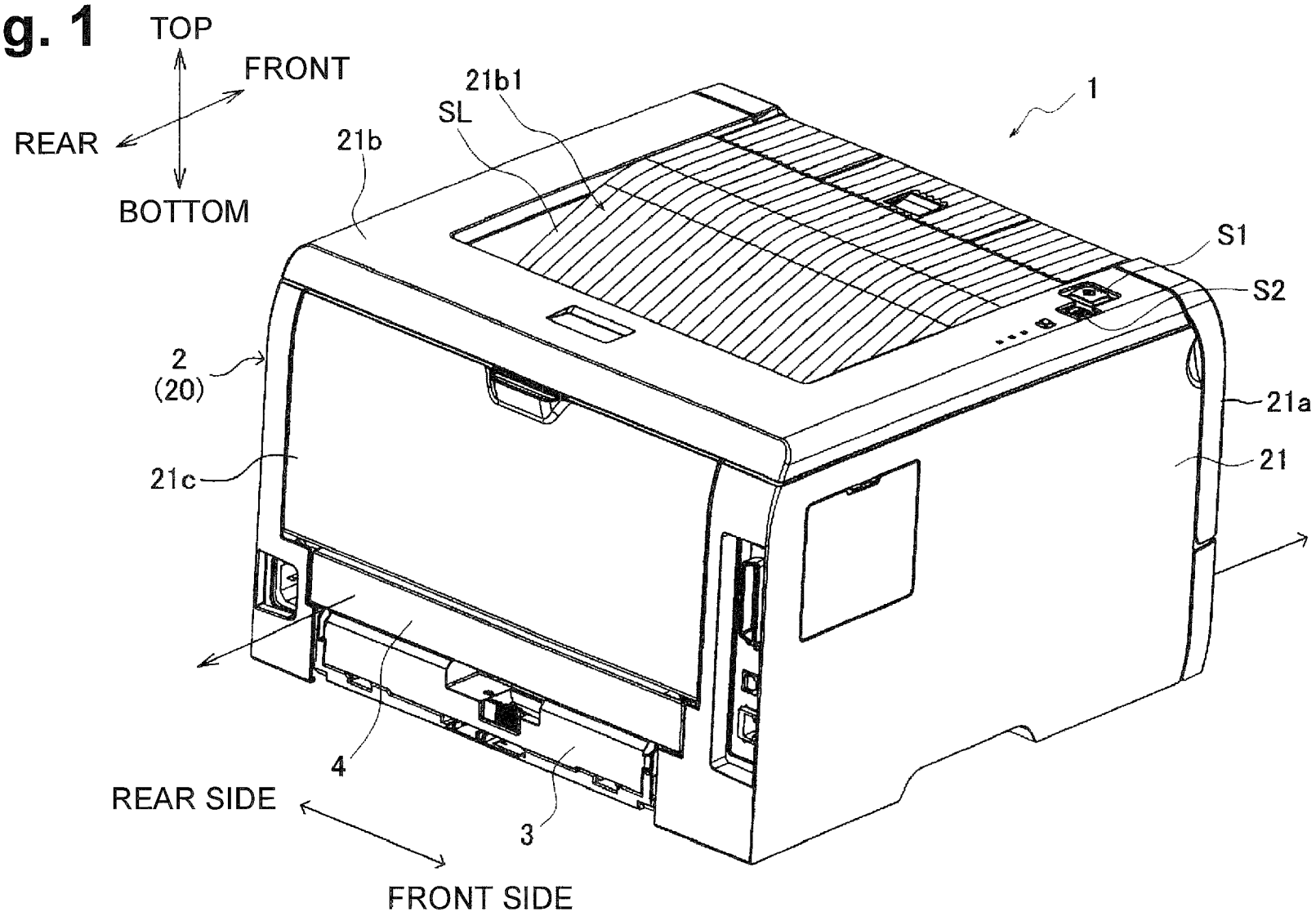
FIG. 1 is a perspective view showing an appearance of a laser printer as an example of an image forming apparatus.
Figure 2:
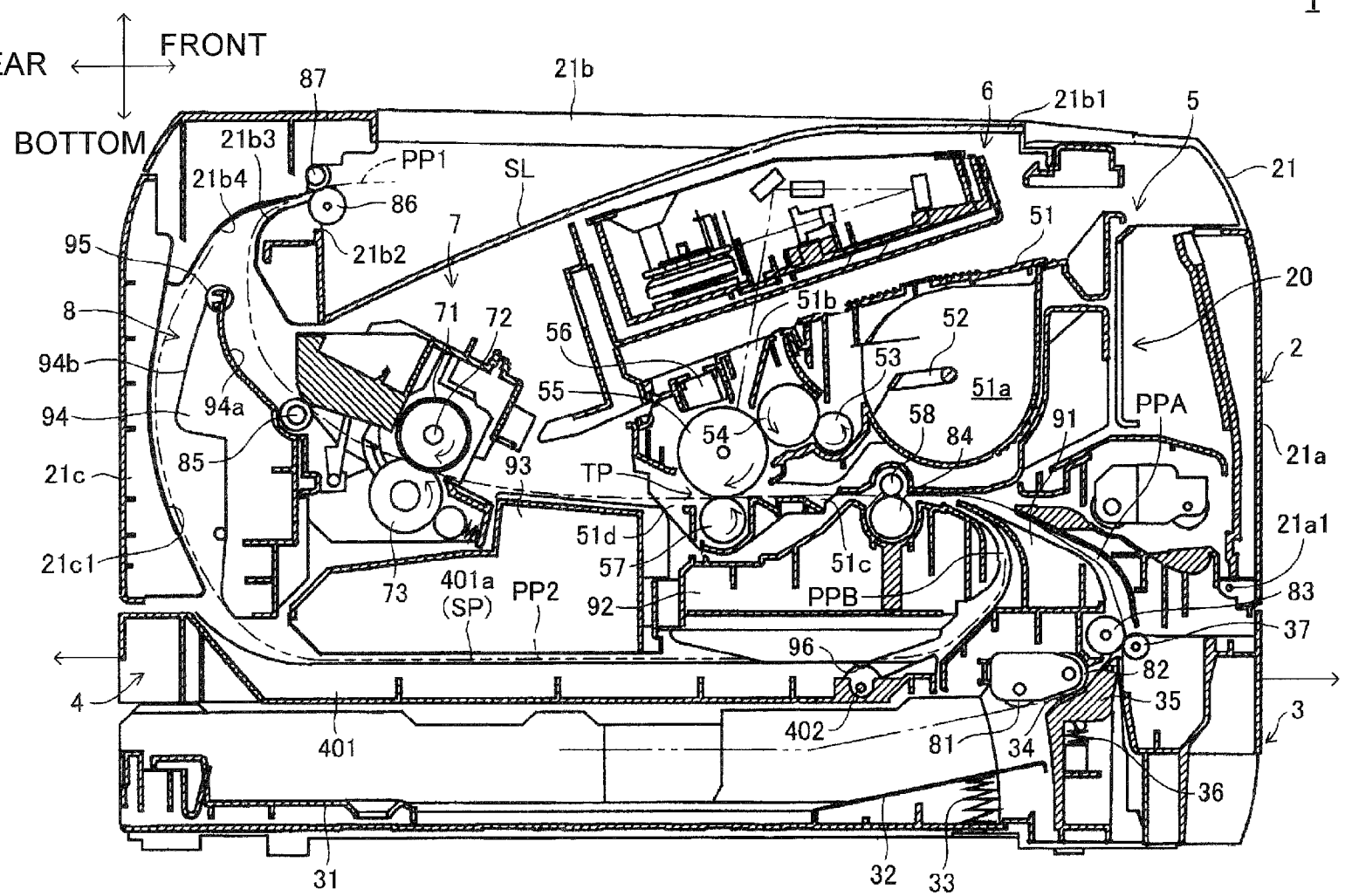
FIG. 2 is a cross-sectional side view showing a schematic configuration of the image forming apparatus.

FIG. 1 is a perspective view showing an appearance of a laser printer 1 as an example of an image forming apparatus. FIG. 2 is a cross-sectional side view showing a schematic configuration of the laser printer 1 shown in FIG. 1. The laser printer 1 is configured to form an image of a developer, e.g., a tonner, (hereinafter, referred to as a "toner image") on paper as an example of a sheet-type recording medium, while transporting the paper along a paper transporting path PP1. The laser printer 1 is, when performing image formation on both sides of the paper, configured to introduce the paper having an image formed on a front side thereof once into a paper reversing path PP2 and then perform the image formation again on a back side thereof while transporting the paper along the paper transporting path PP1 as described later in detail.

A general configuration of the laser printer 1 according to the embodiment will be described schematically with reference to FIG. 1 and FIG. 2 below. Significances of terms "up", "down", "front", "rear", "paper width direction", "near side", and "far side" are shown in respective drawings. In other words, the term "paper width direction" means a direction orthogonal always to the paper transporting path PP1. A direction of tangent at an arbitrary position on the paper transporting path PP1 or the paper reversing path PP2 in the cross-sectional side view as shown in FIG. 2, which is the same direction as the direction in which the paper is transported, is referred to as the "paper transporting direction".

The laser printer 1 includes a body portion 2, a sheet cassette 3 demountably mounted on the body portion 2, and a double-sided printing unit 4 (an example of a transporting unit). Provided in the body portion 2 are an image forming unit 5, a scanner unit 6, a fixing unit 7, and a paper transporting unit 8.

<<Body Portion>>

The body portion 2 includes a body frame 20. The body frame 20 is a frame formed of a metallic plate and formed so as to support respective members provided in the body portion 2, and is electrically grounded. A body casing 21 which constitutes an outer cover (a housing) of the body portion 2 is a box-shaped member formed of a synthetic resin plate member, and is provided so as to cover the body frame 20.

A front cover 21*a* which constitutes a front panel of the body casing 21 is supported so as to be openable and closable by rotating about a front cover rotating shaft 21*a*1 provided at a lower end portion thereof. A top cover 21*b* which constitutes an upper panel of the body casing 21 is provided with switches S1, S2, . . . of various types.

The top cover 21*b* is formed with a paper discharge tray 21*b*1 and a paper discharging port 21*b*2. The paper discharge tray 21*b*1 is formed by a depressed portion having an inclined surface SL formed so as to extend obliquely downward from the front side toward the back side of the body casing 21. The paper discharging port 21*b*2 formed of an opening is formed on a wall surface of the body casing 21 provided so as to extend upright from a lower end portion of the paper discharge tray 21*b*1 upward. In other words, the paper discharge tray 21*b*1 is formed so as to receive the paper discharged from the paper discharging port 21*b*2.

Formed on an inner surface of the top cover 21*b* at a rear end portion thereof is a paper discharging port lower guide 21*b*3 and a paper discharging port upper guide 21*b*4. The paper discharging port lower guide 21*b*3 and the paper discharging port upper guide 21*b*4 are configured to guide the paper, which is transported through the fixing unit 7 toward the paper discharge tray 21*b*1, toward the paper discharging port 21*b*2. The paper discharging port upper guide 21*b*4 is configured to guide a trailing end of the paper fed to a position immediately before the paper discharging port 21*b*2 toward the paper reversing path PP2 when the image formation is performed on both sides of the paper.

A rear cover 21*c* which constitutes a rear side panel of the body casing 21 is provided so as to be demountably mountable when clearing the paper jam or the like. Formed on the inside (that is, the front side) of the rear cover 21*c* is formed with a paper guide 21*c*1. The paper guide 21*c*1 is provided along the paper reversing path PP2 directed from the paper discharging port 21*b*2 toward the double-sided printing unit 4.

<<Sheet Cassette>>

The sheet cassette 3 is provided downward of the body portion 2, and is configured to be demountably mountable with respect to the body portion 2. In other words, the sheet cassette 3 is configured to be demounted from the body portion 2 by being pulled toward the front (see an arrow in the drawing), and mounted to the body portion 2 while being pushed rearward. The sheet cassette 3 is configured to be capable of holding sheet-type paper to be supplied into the body portion 2 in stack.

The sheet cassette 3 includes a cassette case 31, a paper pressing plate 32, a paper pressing spring 33, separation pad 34, a separation pad holder 35, a separation pad urging spring 36, and a roll 37.

The cassette case 31 is a box-shaped member which constitutes a casing of the sheet cassette 3, and is formed of a plate member formed of synthetic resin, which is the same material as that of the body casing 21. In this embodiment, the sheet cassette 3 is configured to be capable of accommodating a number of pieces of the sheet-type paper having a letter size (215.9 mm×279 4 mm) and an A4 size (210 mm×297 mm) on the inside thereof in stack.

The paper pressing plate 32 is arranged in the cassette case 31. The paper pressing plate 32 is pivotably supported about a rear end portion thereof A front end portion, which is a free end portion of the paper pressing plate 32, is urged upward by the paper pressing spring 33.

The separation pad 34 is provided on the front side (the downstream side in the paper transporting direction) with respect to the front end portion of the paper pressing plate 32. The separation pad 34 is formed of a material having a coefficient of friction with respect to the paper higher than a coefficient of friction among pieces of paper (for example, felt or the like), and is supported on an upper surface of the separation pad holder 35. The separation pad holder 35 is urged upward by the separation pad urging spring 36. The roll 37 is rotatably supported on the further front side of the separation pad 34.

<<Image Forming Unit>>

The image forming unit 5 which is an example of an "image forming section" is demountably supported by the body frame 20. The image forming unit 5 is configured to form an image with the toner (the developer) on the paper at a predetermined transfer position TP which is an example of an "image forming position."

A developing unit case 51 which constitutes a casing and a frame of the image forming unit 5 is formed of a synthetic resin made plate member. A toner storage 51*a* is formed on the front side of the developing unit case 51. The toner storage 51*a* is a space configured to accommodate non-magnetic single component toner as the developer. A laser irradiating opening 51*b* as a slit-like opening is provided on a rear upper portion of the developing unit case 51. A paper inlet opening 51*c* and a paper outlet opening 51*d* are provided on a rear lower portion of the developing unit case 51. Detailed description about these openings will be given later.

An impeller-type agitator 52 is arranged on the inside of the toner storage 51*a*. The agitator 52 is rotatably supported by the developing unit case 51. The agitator 52 is configured to agitate toner stored in the toner storage 51*a* by being driven to rotate. The agitator 52 is configured to be capable of feeding the toner toward a supply roller 53 little by little by being driven to rotate.

The supply roller 53 is arranged on the inside of the developing unit case 51 and on the rear side of the toner storage 51*a*. The supply roller 53 includes a metallic rotating center shaft and a sponge layer formed on an outer peripheral portion of the metallic rotating center shaft. The supply roller 53 is rotatably supported by the developing unit case 51. Then, the supply roller 53 is configured to be driven to rotate in the direction indicated by an arrow in the drawing (counterclockwise) via a rotary drive force transmitting mechanism, not illustrated, when forming the image.

Arranged on the inside of the developing unit case 51 and on the rear side of the supply roller 53 is a developing roller 54. The developing roller 54 includes a metallic rotating center shaft and a semiconductive rubber layer formed on an outer peripheral portion of the metallic rotating center shaft. The semiconductive rubber layer is formed by mixing carbon black in synthetic rubber and dispersing the same uniformly therein.

The developing roller 54 is arranged in parallel to the supply roller 53. An axis-to-axis distance between the developing roller 54 and the supply roller 53 is set so that the supply roller 53 is resiliently compressed by mutual pressing between the developing roller 54 and the supply roller 53. The developing roller 54 is rotatably supported by the developing unit case 51. In other words, the developing roller 54 is configured to be driven to rotate in the direction indicated by an arrow in the drawing (counterclockwise: the same direction as the supply roller 53) via the rotary drive force transmitting mechanism, not illustrated, and carry charged tonner on a peripheral surface thereof when forming the image.

Provided on the inside of the developing unit case 51 and on the rear side of the developing roller 54 is a photosensitive drum 55. The photosensitive drum 55 is a cylindrical member formed with a photosensitive layer formed of a photoconductive substance on an outer peripheral portion thereof The photosensitive drum 55 is arranged in parallel to the developing roller 54. An axis-to-axis distance between the photosensitive drum 55 and the developing roller 54 is set so that a peripheral surface of the photosensitive drum 55 and the peripheral surface of the developing roller 54 come into contact with each other via a thin toner layer carried on the peripheral surface of the developing roller 54.

A charger 56 is arranged above the photosensitive drum 55. The charger 56 is supported by the developing unit case 51. The charger 56 is a known scorotron-type charger, and is configured to be capable of charging the peripheral surface of the photosensitive drum 55 uniformly. A laser irradiating opening 5 lb provided at a position above the developing unit case 51 and between the charger 56 and the developing roller 54 is formed so as to allow passage of a laser beam directed on the peripheral surface of the photosensitive drum 55 charged uniformly by the charger 56 and modulated according to image information.

Arranged on the inside of the developing unit case 51 and below the photosensitive drum 55 is a transfer roller 57. The transfer roller 57 is arranged in parallel to the photosensitive drum 55 so as to oppose the peripheral surface of the photosensitive drum 55 across the paper transporting path PP1. The transfer roller 57 is rotatably supported by the developing unit case 51. The transfer roller 57 includes a metallic rotating center shaft and a semiconductive rubber layer formed on an outer peripheral portion of the metallic rotating center shaft. A high-voltage side output terminal of a high-voltage power source, not illustrated, is connected to the rotating center shaft.

In other words, the transfer roller 57 is configured to be driven to rotate in the direction (counterclockwise) indicated by an arrow in the drawing so as to follow the photosensitive drum 55 synchronously with the rotation of the photosensitive drum 55 in the direction indicated by an arrow in the drawing (clockwise) when forming the image. Then, the transfer roller 57 is configured to transfer the toner carried on the peripheral surface of the photosensitive drum 55 to the paper at the transfer position TP by being driven to rotate as described above and applied with a predetermined voltage between the transfer roller 57 and the photosensitive drum 55.

Formed on the upstream side in the paper transporting direction with respect to the above-described transfer position TP, which is a position where the transfer roller 57 and the photosensitive drum 55 oppose each other, is the paper inlet opening 51*c*. Formed on the downstream side in the paper transporting direction with respect to the above-described transfer position TP is the paper outlet opening 51*d*. In other words, the paper inlet opening 51*c* and the paper outlet opening 51*d* are provided so that the paper supplied toward the image forming unit 5 passes through the paper inlet opening 51*c*, enters the image forming unit 5, passes through the transfer position TP, then passes through the paper outlet opening 51*d*, and goes out from the image forming unit 5.

In other words, the image forming unit 5 is configured to form an image with toner on paper by forming a toner image on the peripheral surface of the photosensitive drum 55 by developing an electrostatic latent image formed by the above-described laser beam radiated on the peripheral surface of the photosensitive drum 55 charged uniformly by the charger 56 with toner carried on the developing roller 54, and transform the toner image onto the paper at the transfer position TP.

Provided on the outside of a bottom portion of the developing unit case 51 and on the upstream side in the paper transporting direction with respect to the paper inlet opening 51*c* is an opposing roller 58. The opposing roller 58 is arranged so as to oppose the paper transporting path PP1 from the upper side and is supported by the developing unit case 51 so as to be rotatable.

<<Scanner Unit>>

The scanner unit 6 is arranged above the image forming unit 5. The scanner unit 6 is configured to generate the above-described laser beam used for forming the toner image in the image forming unit 5, and to direct the generated laser beam toward the peripheral surface of the photosensitive drum 55 provided in the image forming unit 5 while operating the laser beam along the paper width direction.

<<Fixing Unit>>

The fixing unit 7 is arranged on the downstream side in the paper transporting direction with respect to the transfer position TP, and is configured to fix the toner image formed on the paper by the image forming unit 5 onto the paper. The fixing unit 7 includes a heating roller 71, a heater 72, and a pressing roller 73.

The heating roller 71 is a thin hollow cylindrical member formed of a metal whose surface is subject to surface treatment for mold release, and is arranged in parallel to the paper width direction. The heater 72 is accommodated on the inside of the heating roller 71. The pressing roller 73 is a roller formed of silicon rubber, and is arranged in parallel to the heating roller 71. The pressing roller 73 is pressed against the heating roller 71 by a spring or the like with a predetermined pressure.

The fixing unit 7 is configured to nip the paper between the heating roller 71 and the pressing roller 73 rotating in the directions indicated by arrows in the drawing, thereby feeding the paper in the paper transporting direction while fixing the toner image adhered to the surface of the paper on the upper side in the drawing, on that surface.

<<Paper Transporting Unit>>

The paper transporting unit 8 transports the pieces of paper placed in the sheet cassette 3 in stack one by one along the paper transporting path PP1 and, when performing the image formation on the both sides of the paper, is configured to once transport the paper passed through the transfer position TP and the fixing unit 7 along the paper reversing path PP2 to the double-sided printing unit 4. More specifically, the paper transporting unit 8 includes a pickup roller 81, a separation roller 82, a paper feeding roller 83 (an example of a feed roller), a registration roller 84, an after-fixation paper feeding roller 85, a paper discharging drive roller 86, and a paper discharging driven roller 87. The pickup roller 81, the separation roller 82, the paper feeding roller 83, the registration roller 84, the after-fixation paper feeding roller 85, and the paper discharging drive roller 86 are configured to be driven to rotate via the rotary drive force transmitting mechanism, not illustrated.

Provided in a bottom portion on the front side of the body portion 2 so as to oppose a free end portion of the paper pressing plate 32 is the pickup roller 81 formed of a rubber roller. The pickup roller 81 is configured to feed a topmost piece of paper from the pieces of paper placed in the sheet cassette 3 in stack toward the separation pad 34 in the paper transporting direction (toward the front in this case).

The separation roller 82 formed of a rubber roller is provided so as to oppose the separation pad 34 provided in the sheet cassette 3 at a position adjacent to the pickup roller 81 in the paper transporting direction. The separation roller 82 is configured to separate and transport only the topmost piece of paper toward the paper feeding roller 83 by cooperating with the separation pad 34.

The paper feeding roller 83 formed of a rubber roller is provided so as to oppose the roll 37 at a destination of paper separated by the separation roller 82. The paper feeding roller 83 is configured to transport the paper separated by the separation roller 82 and the separation pad 34 toward a registration position where the opposing roller 58 and the registration roller 84 oppose each other provided under the image forming unit 5 in cooperation with the roll 37.

The registration roller 84 formed of a rubber roller is provided right below the opposing roller 58. The registration roller 84 which constitutes the "paper feeding roller" is arranged on the upstream side of the transfer position TP in the paper transporting direction, and is supported rotatably by the body frame 20 so as to transport the paper to the transfer position TP. The registration roller 84 is configured to correct the inclination of a leading end of the paper in the paper transporting direction and adjust the timing at which the leading end of the paper passes the transfer position TP in cooperation with the rotatable opposing roller 58 which is rotated so as to follow the registration roller 84 by being driven to rotate.

Provided at the destination of the paper transported by the heating roller 71 and the pressing roller 73 in the fixing unit 7 is the after-fixation paper feeding roller 85. The after-fixation paper feeding roller 85 is configured to feed the paper passed through the fixing unit 7 and fixed with the toner image thereon toward the space between the paper discharging port lower guide 21*b*3 and the paper discharging port upper guide 21*b*4.

The paper discharging port 21*b*2 is provided with the paper discharging drive roller 86 and the paper discharging driven roller 87 which constitute a "paper feed reversing unit." The paper discharging drive roller 86 is rotatably supported by the body frame 20. The paper discharging driven roller 87 is arranged above the paper discharging drive roller 86, and is rotatably supported by the top cover 21*b* so as to follow the rotary drive of the paper discharging drive roller 86.

The paper discharging drive roller 86 is configured to be capable of rotating in normal and reverse directions, namely, clockwise and counterclockwise in the drawing, by the rotary drive force transmitting mechanism, not illustrated. In other word, the paper discharging drive roller 86 is driven to rotate clockwise in the drawing when discharging the paper on which an image is formed on one side to the paper discharge tray 21*b*1 via the image forming unit 5 and the fixing unit 7, and, on the other hand, is driven to rotate counterclockwise in the drawing when transporting the paper toward the double-sided printing unit 4 along the paper reversing path PP2 in order to reverse the paper and transport the reversed paper again to the transfer position TP.

Provided in the body portion 2 along the paper transporting path PP1 and the paper reversing path PP2 are a first paper guide 91, a second paper guide 92, a third paper guide 93, and a fourth paper guide 94. The first paper guide 91 is arranged on the front side of the lower portion of the body portion 2, above the pickup roller 81, the separation roller 82, and the paper feeding roller 83, and also below the image forming unit 5 so as to form the paper feed path PPA on the downstream of a feeder for guiding the paper fed from the sheet cassette 3 from the paper feeding roller 83 to the registration position described above.

Provided below the image forming unit 5 is the second paper guide 92 so as to be adjacent to the back side of the first paper guide 91. A reverse paper feed path PPB for guiding the paper from the double-sided printing unit 4 toward the registration position is formed by a gap between the second paper guide 92 and the first paper guide 91. In this embodiment, the reverse paper feed path PPB is formed into a substantially J-shape or a substantially C-shape (so as to cause the leading edge of the paper leaving the double-sided printing unit 4 to be transported forward and obliquely upward once and then to be transported rearward and obliquely upward). The registration roller 84 is provided on an upper end portion of the second paper guide 92.

The third paper guide 93 is arranged between the paper outlet opening 51*d* of the image forming unit 5 and the fixing unit 7. The third paper guide 93 is provided so as to guide transport of the paper on which the toner is formed but not fixed to the fixing unit 7 via the image forming unit 5, and define an upper end of the paper reversing path PP2.

The fourth paper guide 94 is provided so as to oppose the paper guide 21*c*1 of the rear cover 21*c* so as to guide the paper after fixation fed by the after-fixation paper feeding roller 85 toward a space between the paper discharging port lower guide 21*b*3 and the paper discharging port upper guide 21*b*4 and guide the paper reversely fed by the paper discharging drive roller 86 toward the double-sided printing unit 4 along the paper reversing path PP2. In other words, an upstream portion of the paper reversing path PP2 in the paper transporting direction, which is a portion from the space between the paper discharging port lower guide 21*b*3 and the paper discharging port upper guide 21*b*4 to the double-sided printing unit 4, is defined by a space surrounded by an after-fixation paper intake guide surface 94*b* and the paper guide 21*c*1.

An after-fixation paper discharge guide surface 94*a*, which is a front surface of the fourth paper guide 94 (the surface along the paper transporting path PP1) is formed so as to guide the paper after fixation smoothly toward the space between the paper discharging port lower guide 21*b*3 and the paper discharging port upper guide 21*b*4. In contrast, the after-fixation paper intake guide surface 94*b*, which is a back surface of the fourth paper guide 94 (the surface along the paper reversing path PP2), is formed so as to guide the paper reversely transported by the paper discharging drive roller 86 after fixation smoothly to the double-sided printing unit 4.

An after-fixation paper guide roll 95 is rotatably supported at an upper end of the fourth paper guide 94. The after-fixation paper guide roll 95 is provided so as to reduce the friction between the paper fed downstream of the fixing unit 7 in the paper transporting direction and the upper end of the fourth paper guide 94 and to reduce the friction between the paper fed toward the double-sided printing unit 4 along the paper reversing path PP2 and the upper end of the fourth paper guide 94.

A reversing paper supply roll 96 is rotatably supported at a position opposing a front end portion of the double-sided printing unit 4. The reversing paper supply roll 96 is provided at a lower end portion of the second paper guide 92. The reversing paper supply roll 96 is configured to be rotated so as to follow the paper received once in the double-sided printing unit 4 when being fed toward the above-described registration position.

<<Double-Sided Printing Unit>>

The double-sided printing unit 4 is provided between the second paper guide 92 and the third paper guide 93 and the sheet cassette 3 in the body portion 2. The double-sided printing unit 4 corresponding to a "transporting unit" is configured to receive (support) the paper reversely fed by the paper discharging drive roller 86 once and transport again to the above-described registration position.

The double-sided printing unit 4 is supported in the body frame 20. The double-sided printing unit 4 is configured to be demountably mountable along the paper transporting direction in a bottom portion of the paper reversing path PP2, which is a substantially linear portion extending in the fore-and-aft direction in cross-sectional side view so as to be capable of being pulled out rearward when clearing the paper jam or the like (see an arrow in the drawing).

Figure 3:
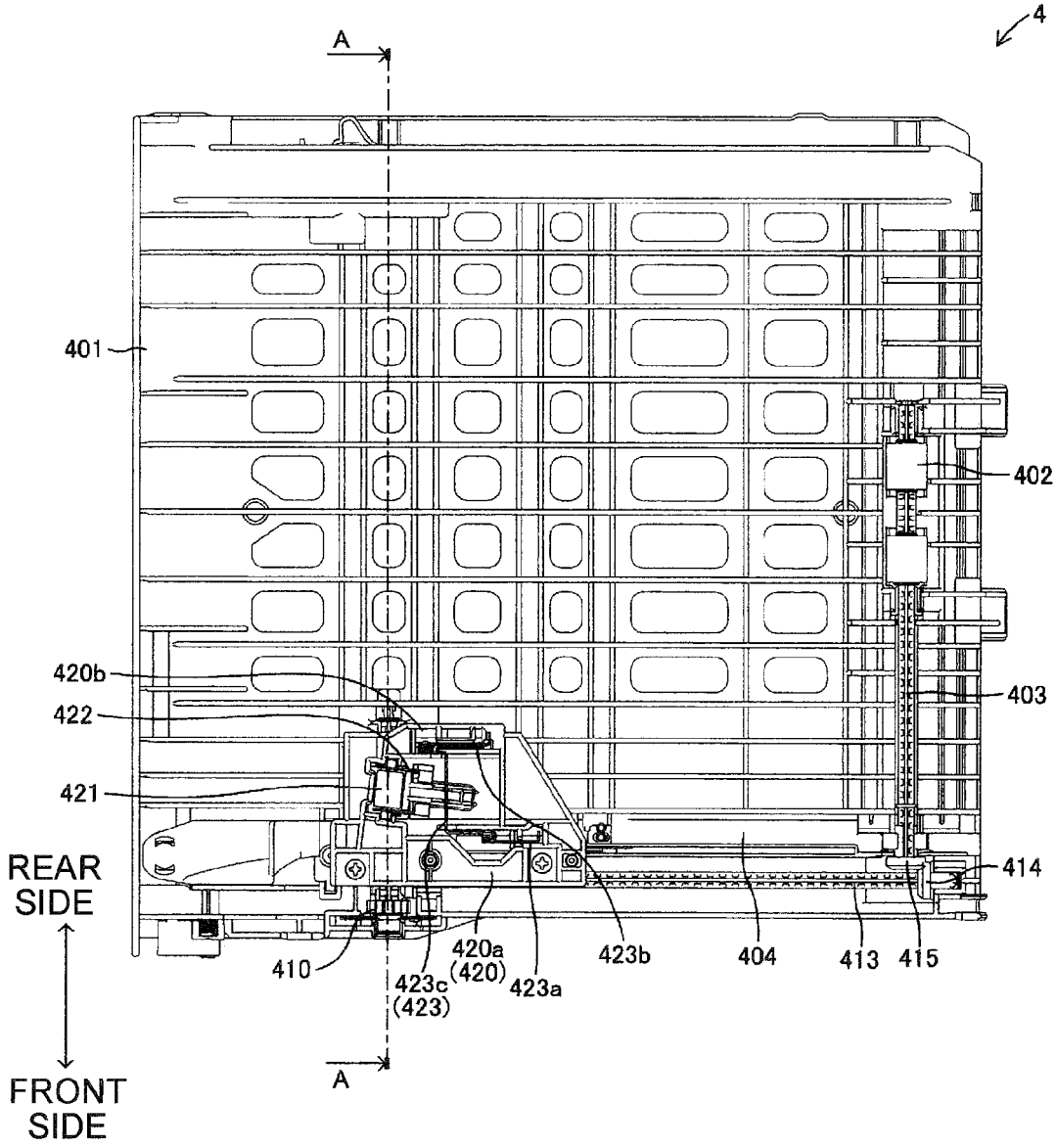
FIG. 3 is a plan view of a double-sided printing unit.
Figure 4:
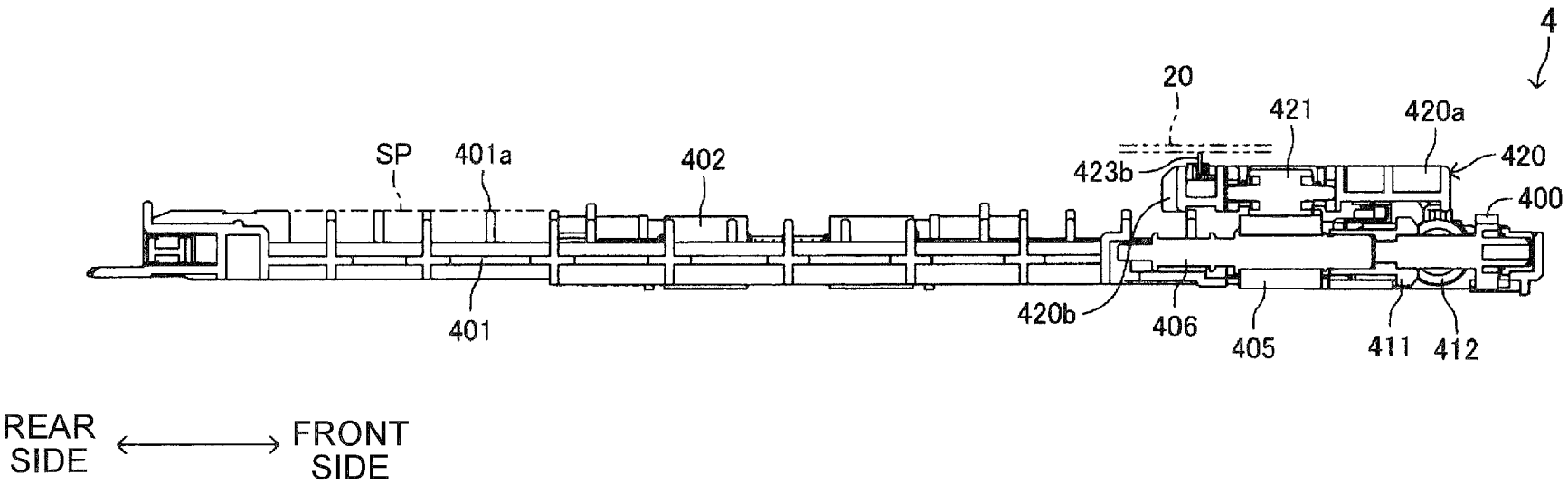
FIG. 4 is a cross-sectional view taken along the line A-A in FIG. 3.
Figure 5:
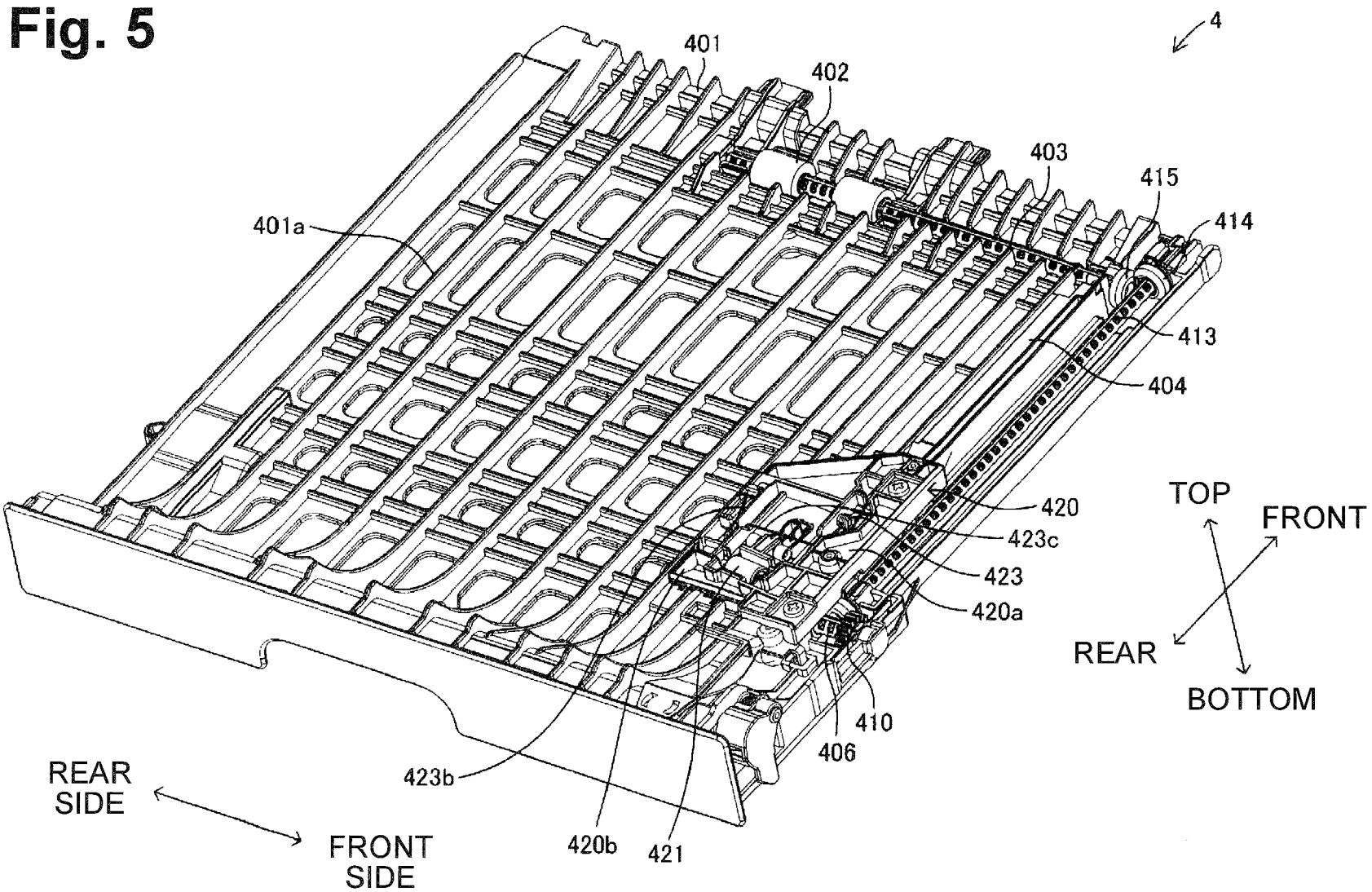
FIG. 5 is a perspective view showing the double-sided printing unit.
Figure 6:
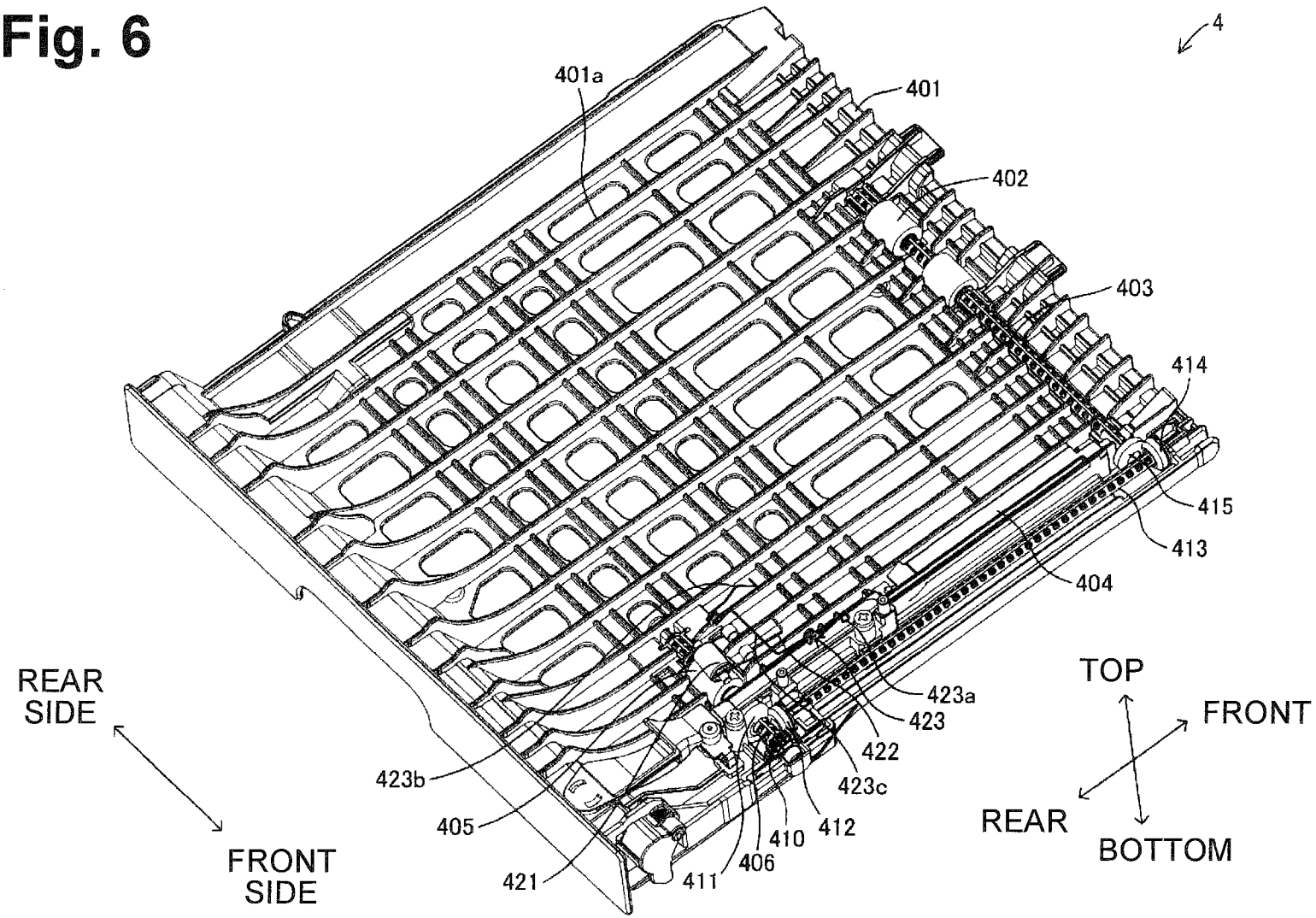
FIG. 6 is a perspective view showing the double-sided printing unit a part of which is omitted.

FIG. 3 is a plan view of the double-sided printing unit 4 shown in FIG. 2. FIG. 4 is a cross-sectional view taken along the line A-A in FIG. 3. FIG. 5 is a perspective view of the double-sided printing unit 4 shown in FIG. 3. FIG. 6 is a perspective view of the double-sided printing unit 4 a part of which is omitted. Referring now to FIG. 2 to FIG. 6, a configuration of the double-sided printing unit 4 in this embodiment will be described in detail below.

A body portion of the double-sided printing unit 4, which is a transporting tray 401, is a synthetic resin plate member having a rectangular shape in plan view and includes a number of guide ribs 401*a* provided along the fore-and aft direction. The guide ribs 401*a* are provided so as to oppose the bottom portion of the paper reversing path PP2. In other words, a paper supporting surface of the transporting tray 401 (the surface supporting the paper in the course of being re-transported to the transfer position TP; hereinafter, referred to as a "reversed paper supporting surface SP" (see FIG. 2 and FIG. 4)) is formed by upper ends of the guide ribs 401*a*.

A re-transport drive roller 402 is provided right below the reversing paper supply roll 96 so as to oppose the reversing paper supply roll 96 across the paper reversing path PP2. The re-transport drive roller 402 is a rubber roller fixed to a re-transport drive roller shaft 403 extending in parallel to the paper width direction, and is rotatably supported at a front end portion of the transporting tray 401.

A side guide 404 is mounted at an end portion of the transporting tray 401 on the near side in the paper width direction. The side guide 404 is a metallic rod-shaped member, and is provided along the fore-and-aft direction so as to control the position of the paper (perform side registration in a mode of aligning the paper on the near side) in the paper width direction by coming into abutment with an end edge of the paper on the near side in the paper width direction. A configuration of the side guide 404 is known (see JP-A-2004-294988, if necessary), further detailed description is omitted in this specification.

A side registration drive roller 405 is provided on the transporting tray 401 on the near side in the paper width direction and on the far side with respect to the side guide 404. The side registration drive roller 405, which is one of a "pair of skew transporting rollers" is a rubber roller fixed to a side registration drive shaft 406 extending in parallel to the paper width direction, and is rotatably supported by the transporting tray 401 on the upstream side with respect to the re-transport drive roller 402 in the paper transporting direction.

The re-transport drive roller 402 and the side registration drive roller 405 are configured to re-transport the paper supported on the reversed paper supporting surface SP in the paper transporting direction toward the transfer position TP upon receipt of transmission of the drive force from the body portion 2. More specifically, the double-sided printing unit 4 is provided with a passive gear 410, a bevel gear 411, a bevel gear 412, a drive force transmitting shaft 413, a bevel gear 414, and a bevel gear 415, which are a drive force transmitting mechanism for driving these rollers to drive to rotate.

The passive gear 410 configured to receive the transmission of a rotary drive force from a drive gear by meshing with the drive gear, not illustrated, provided on the body portion 2 (which is driven to rotate via a motor, not illustrated, provided on the body portion 2) is mounted on an end portion of the side registration drive shaft 406 on the near side in the paper width direction. Mounted at a position between the side registration drive roller 405 and the passive gear 410 of the side registration drive shaft 406 is the bevel gear 411. The bevel gear 412 to be meshed with the bevel gear 411 is mounted on a rear end portion of the drive force transmitting shaft 413 provided in parallel to the paper transporting direction.

The drive force transmitting shaft 413 is rotatably supported at an end portion of the transporting tray 401 on the near side in the paper width direction, which is the side nearer than the side guide 404 (outside). The bevel gear 414 is mounted on a front end portion of the drive force transmitting shaft 413. The bevel gear 414 is provided so as to mesh with the bevel gear 415 mounted on an end portion of the re-transport drive roller shaft 403 on the near side in the paper width direction.

An opposing plate 420 is provided above the side registration drive roller 405. The opposing plate 420 is a plate member provided so as to oppose the reversed paper supporting surface SP of the transporting tray 401, and is supported in a cantilevered manner by the transporting tray 401 by a fixed end portion 420*a* which is an end portion on the near side in the paper width direction being fixed to the transporting tray 401 on the nearer side of the side guide 404 in the paper width direction (outside: but inside of the drive force transmitting shaft 413). A free end portion 420*b*, which is an end portion on the far side of the opposing plate 420 in the paper width direction, extends to a position opposing an end portion of the side registration drive shaft 406 on the far side in the paper width direction.

A skew roller 421 is provided so as to oppose the side registration drive roller 405 above the side registration drive roller 405. The skew roller 421, which is the other one of the "pair of the skew transport rollers" is rotatably supported by the opposing plate 420 about a rotating center shaft inclined with respect to the paper width direction. The skew roller 421 is configured to follow the rotary drive of the side registration drive roller 405. In other words, the side registration drive roller 405 and the skew roller 421 are configured to cause the paper supported by the transporting tray 401 to skew toward the side guide 404 and to be transported toward the transfer position TP in the paper transporting direction in abutment with the side guide 404.

A skew roller pressing spring 422 is mounted on the opposing plate 420. The skew roller pressing spring 422 is formed of a metallic wire and is provided so as to press the skew roller 421 toward the side registration drive roller 405.

An earth spring 423 (an example of an urging member) is mounted on the opposing plate 420. The earth spring 423 is formed of a metallic wire, and a side guide-side contact point 423*a*, which is one end portion thereof, is brought into abutment with the side guide 404 and a body-side contact point 423*b*, which is the other end portion thereof, is brought into abutment with a portion of the body frame 20 opposing the reversed paper supporting surface SP (see FIG. 4) are provided in order to ground the side guide 404 via the body frame 20.

The side guide-side contact point 423*a* which constitutes a "side guide grounding member" is a rod-shaped member having a longitudinal direction along the fore-and-aft direction (the direction of mounting and demounting with respect to the body frame 20 of the double-sided printing unit 4), and a front end portion thereof is provided so as to come into abutment with the side guide 404. A rear end portion of the side guide-side contact point 423*a* is integrally connected to the body-side contact point 423*b* via a connecting portion 423*c*, which is a rod member having the longitudinal direction along the paper width direction. The connecting portion 423*c* is provided so as to come into contact with the skew roller pressing spring 422 by overlapping with the skew roller pressing spring 422 in plan view.

The body-side contact point 423*b* which is an example of an "urging unit" is provided so as to urge a portion of the opposing plate 420 on the far side (inside) with respect to the fixed end portion 420*a* in the paper width direction downward toward the reversed paper supporting surface SP (that is, in the direction opposite from a reaction force which acts on the opposing plate 420 by a pressing force by the above-described skew roller pressing spring 422) by coming into abutment with the body frame 20 when the double-sided printing unit 4 is mounted on the body frame 20. In particular, in this embodiment, the body-side contact point 423*b* is provided so as to urge the free end portion 420*b* of the opposing plate 420 toward the reversed paper supporting surface SP.

More specifically, the body-side contact point 423*b* is a wire member extending in a longitudinal direction along the fore-and-aft direction (the direction of mounting and demounting of the double-sided printing unit 4 with respect to the body frame 20), and is bent into an inverted V-shape in side view so as to project toward the portion opposing the reversed paper supporting surface SP of the body frame 20 (see FIG. 4). In other words, the fixed end portion 420*a* of the opposing plate 420, the side guide 404, the skew roller 421, and the body-side contact point 423*b* are arranged in this sequence from the near side to the far side in the paper width direction.

In this embodiment, a distal end portion (a front end portion) of the body-side contact point 423*b* is configured to engage the opposing plate 420 by being bent along the paper width direction (more specifically, toward the far side) so as to prevent the double-sided printing unit 4 from separating easily from the opposing plate 420 when mounting on and demounting from the body frame 20.

<Schematic Description of Image forming Action of Laser Printer>

Referring now to the drawings, a schematic description of the image forming action of the laser printer 1 having the configuration as described above will be given.

<<Paper Feeding Action>>

Referring to FIG. 2, pieces of paper are stored in the cassette case 31 in stack. The paper is urged upward toward the pickup roller 81 by the paper pressing plate 32. Accordingly, the uppermost piece of paper in the cassette case 31 comes into contact with a peripheral surface of the pickup roller 81.

When the pickup roller 81 is driven to rotate counterclockwise in the drawing, a leading end portion of the topmost piece of paper moves rightward in the drawing. However, due to the friction among the pieces of paper, not only the topmost piece of paper, but also several pieces of paper located below may move rightward in the drawing together with the topmost piece of paper. In this case, the leading ends of the several pieces of paper including the topmost piece of paper in the cassette case 31 is nipped between the separation roller 82 and the separation pad 34.

Here, the separation roller 82 is driven to rotate counterclockwise in the drawing. At this time, the frictional force between a peripheral surface of the separation roller 82 and the topmost piece of paper is larger than the frictional force between the pieces of the paper. Therefore, the leading end portion of the topmost piece of paper coming into contact with the peripheral surface of the separation roller 82 can move in association with the rotation of the separation roller 82. In contrast, slippage occurs between the topmost piece of paper and the pieces of paper located below. Also, the movement of the leading ends of the pieces of paper located below the topmost piece of paper is blocked by the separation pad 34.

In this manner, only the topmost piece of paper coming into contact with the peripheral surface of the separation roller 82 moves in association with the rotation of the separation roller 82. Then, the leading end of the topmost piece of paper is transported toward the registration position where the opposing roller 58 and the registration roller 84 are in contact.

After the leading end of the paper is brought into abutment with the registration position, the registration roller 84 is driven to rotate at a predetermined timing. Then, the opposing roller 58 is rotated so as to follow the rotation of the registration roller 84. Accordingly, the paper is transported toward the transfer position TP, which is a position where the photosensitive drum 55 and the transfer roller 57 oppose each other. In this manner, correction of skewing of the paper and timing adjustment of transport are performed.

Subsequently, the paper enters the image forming unit 5 via the paper inlet opening 51*c*. Then, a toner image is formed on (transferred to) the upper surface of the paper at the transfer position TP in the image forming unit 5 in the following manner.

<<Formation of Electrostatic Latent Image>>

While the paper is transported toward the transfer position TP as described above, the toner image is carried on the peripheral surface of the photosensitive drum 55 in the following manner.

The peripheral surface of the photosensitive drum 55 is uniformly charged by the charger 56 at a position right below the charger 56. The peripheral surface of the photosensitive drum 55 charged by the charger 56 is fed to a position opposing the laser irradiating opening 51*b* by the rotation of the photosensitive drum 55 in the direction (clockwise) indicated by an arrow in the drawing.

The uniformly charged peripheral surface of the photosensitive drum 55 is irradiated with a laser beam by the scanner unit 6 at a position opposing the laser irradiating opening 51*b*. The laser beam is generated on the basis of image data. In other words, a state of light emission of the laser beam (ON/OFF pulse shapes) is modulated according to the image data. Accordingly, an electrostatic latent image is formed on the peripheral surface of the photosensitive drum 55. Then, the peripheral surface of the photosensitive drum 55 formed with the electrostatic latent image in this manner is fed to a position in contact with or in the proximity to the peripheral surface of the developing roller 54 by the rotation of the photosensitive drum 55 in the direction (clockwise) indicated by an arrow in the drawing.

<<Development of Electrostatic Latent Image, Transfer of Toner Image>>

As described above, the developing roller 54 and the supply roller 53 rotate in the directions (counterclockwise) indicated by arrows in the drawing. Accordingly, friction is generated between the peripheral surface of the developing roller 54 and the supply roller 53 at a position of contact. This friction allows the charged toner to be carried on the peripheral surface of the developing roller 54.

The peripheral surface of the developing roller 54 having the toner carried thereon in this manner reaches the position opposing the photosensitive drum 55 by the rotation in the direction (counterclockwise) indicated by an arrow in the drawing.

Then, by the contact or proximity between the peripheral surface of the photosensitive drum 55 having the electrostatic latent image formed thereon and the peripheral surface of the developing roller 54 having the charged tonner carried thereon, the toner is adhered to the peripheral surface in a pattern corresponding to the electrostatic latent image formed on the peripheral surface of the photosensitive drum 55. In other words, the electrostatic latent image on the peripheral surface of the photosensitive drum 55 is developed by the toner, and the toner image is carried on the peripheral surface.

The toner image carried on the peripheral surface of the photosensitive drum 55 in a manner described above is transported toward the above-described transfer position by the rotation of the peripheral surface in the clockwise direction in the drawing. Then, at this transfer position, the toner image is transferred from the peripheral surface of the photosensitive drum 55 onto the paper.

<<Fixation, Paper Discharge>>

As described above, the paper on which the toner image is formed (transferred) at the transfer position TP passes through the paper outlet opening 51*d* and is discharged from the image forming unit 5. Then, the toner image transferred paper is fed to the fixing unit 7 along the paper transporting path PP1 while being guided on its back side by the third paper guide 93.

The toner image transferred paper transported via the third paper guide 93 is pressurized and heated by the heating roller 71 and the pressing roller 73 while being nipped therebetween. Accordingly, the toner image is fixed onto the surface of the paper.

Subsequently, the after-fixation paper is fed toward the after-fixation paper feeding roller 85 by the rotation of the heating roller 71 and the pressing roller 73 in the directions indicated by arrows in the drawing.

Furthermore, the after-fixation paper is fed toward a nip between the paper discharging drive roller 86 and the paper discharging driven roller 87 by the after-fixation paper feeding roller 85 while being guided by the after-fixation paper discharge guide surface 94*a* of the fourth paper guide 94, the after-fixation paper guide roll 95, and the paper discharging port lower guide 21*b*3 and the paper discharging port upper guide 21*b*4 of the top cover 21*b*.

Then, by the paper discharging drive roller 86 being driven to rotate clockwise in the drawing, the after-fixation paper is discharged from the paper discharging port 21*b*2 toward the paper discharge tray 21*b*1. When performing one-side image formation, the trailing end of the paper passes between the paper discharging drive roller 86 and the paper discharging driven roller 87, whereby the paper is discharged completely from the paper discharging port 21*b*2.

<<Double-Sided Image Formation>>

When performing double-sided image formation, the paper discharging drive roller 86 is reversely rotated before the paper having been subject to the image formation on a first surface is completely discharged from the paper discharging port 21*b*2. In other words, the paper discharging drive roller 86 is driven to rotate counterclockwise in the drawing before a trailing end of the paper having formed with the image on the first surface, which is fed to a position immediately before the paper discharging port 21*b*2, passes through the nip between the paper discharging drive roller 86 and the paper discharging driven roller 87. Accordingly, the trailing end of the paper having formed with the image on the first surface, that is, the leading end of the paper to be formed with the image on the second surface is introduced into the paper reversing path PP2 by the paper discharging port upper guide 21*b*4.

The paper to be formed with the image on the second surface is transported toward the transporting tray 401 of the double-sided printing unit 4 through the paper reversing path PP2 formed between the paper guide 21*c*1 in the rear cover 21*c* and the after-fixation paper intake guide surface 94*b* of the fourth paper guide 94.

Referring now to FIG. 3 to FIG. 6, when the leading end of the paper to be formed with the image on the second surface transported toward the transporting tray 401 reaches a position where the side registration drive roller 405 and the skew roller 421 oppose (nip), the paper to be formed with the image on the second surface is fed toward the re-transport drive roller 402 while being subject to the side registration by the end edge of the paper on the near side in the paper width direction coming into abutment with the side guide 404 by the side registration drive roller 405 and the skew roller 421. The paper to be formed with the image on the second surface supported on the transporting tray 401 in this manner is in a state in which the first surface on which the image is already formed and fixed faces upward.

Referring now to FIG. 2, the leading edge of the paper to be formed with the image on the second surface supported on the transporting tray 401 is then fed to the registration position via the reversing paper feeding path PPB by the reversing paper supply roll 96 and the re-transport drive roller 402. Then, the image formation is performed on the second surface in the same manner as described above.

<Effects and Advantages of Configuration in Embodiment>

With the configuration of the embodiment, a cantilevered supporting state of the opposing plate 420 is preferably maintained by the free end portion 420*b* of the opposing plate 420 being urged in the direction opposite from the reaction force applied to the opposing plate 420 by the pressing force of the skew roller pressing spring 422. Therefore, according to the embodiment, the side registration transport of the paper by the double-sided printing unit 4 is achieved more stable with a more simple apparatus configuration.

Here, the body-side contact point 423*b* of the earth spring 423, which is a configuration for urging the free end portion 420*b* of the opposing plate 420 as described above, is a configuration required for grounding the members provided on the double-sided printing unit 4, which are needed to be grounded, (the side guide 404, or the like) through the body frame 20. In other words, in this embodiment, the cantilevered supporting state of the opposing plate 420 is preferably maintained by using the configuration for grounding the members provided in the double-sided printing unit 4. Therefore, according to the embodiment, grounding of the members provided on the double-sided printing unit 4 and maintaining of the cantilevered supporting state of the opposing plate 420 can be realized preferably with a simple apparatus structure.

<List of Examples of Modifications>

The embodiment described above is only an example of the representative embodiment that the applicant considers to be the best mode at the time of filing of the present application. Therefore, the invention is not limited to the embodiment described above. Therefore, various modifications with respect to the above-described embodiment can be made without changing the essential portions of the invention as a matter of course.

Some representative examples of modifications will be shown below. In the description of the modifications given below, the same configurations and the functions as the components described in the above-described embodiment can be designated by the same reference numerals as those in the embodiment described above. Then, description of these members can be incorporated herein without causing any technical conflict. The modifications are not limited to those listed below as a matter of course. Plural modifications are applied compositely as needed within a range which does not cause any technical conflict.

The object of application is not limited to the double-sided printing unit 4. In other words, for example, the invention is also preferably applicable to the second paper guide 92. In other words, the invention is preferably applicable to the side registration in the case of a one-side printing. The expression "unit" has no relation to whether or not being demountably mountable (easily mounted or demounted) with respect to the body frame 20. Therefore, the invention is not limited to the mode in which the double-sided printing unit 4 is demountably mountable with respect to the body frame 20.

The positional relationship between the side registration drive roller 405 and the skew roller 421 may be vice versa. In other words, a configuration in which the side registration drive roller 405 is provided on the opposing plate 420 and the skew roller 421 is provided on the transporting tray 401 is also applicable. The skew roller pressing spring 422 can be omitted.

The configuration of the earth spring 423 is not limited to the mode disclosed in the embodiment described above in detail. For example, the bending state of the body-side contact point 423*b* is not limited to the "inverted V-shape", and may be an "inverted U-shape" or an "arcuate shape". Also, the connecting portion 423*c* may be separated from the skew roller pressing spring 422.

Other modifications which are not set forth above are included in the technical range of the invention as a matter of course within a range which does not change the essential part of the invention. Also, the elements expressed having effects and functions among the respective elements which constitutes means for solving the problems of the invention also include any structure which achieves the effects and the functions in addition to the specific structures which are disclosed in the embodiment or the modification shown above. In addition, the contents of other applications or the publications (including specification and drawings) cited in this specification may be incorporated herein by reference as needed and without causing any technical conflicts as the construction of the part of this specification.

What is claimed is:

1. An image forming apparatus configured to transport a recording medium, comprising:

a body frame;

an image forming unit supported by the body frame and configured to form an image on the recording medium;

a feed roller configured to transport the recording medium toward the image forming unit; and a transporting unit supported in the body frame and configured to transport the recording medium in a transporting direction toward the feed roller, the transporting unit including:

a transporting tray, which is a rectangular plate-shaped member in plan view, configured to support the recording medium which is being transported;

a side guide disposed at an end portion of the transporting tray in a width direction perpendicular to the transporting direction and configured to abut with an end of the recording medium in the width direction;

an opposing plate supported in a cantilevered manner by the transporting tray, the opposing plate being fixed to the transporting tray on an outside of the side guide in the width direction;

a skew roller, which is rotatably supported by the opposing plate, configured to skew the recording medium toward the side guide such that the skewed recording medium abuts with the side guide; and an urging member configured to urge a portion of the opposing plate toward the transporting tray.

2. The image forming apparatus according to claim 1, wherein the urging member is configured to urge a distal end portion of the opposing plate toward the transporting tray.

3. The image forming apparatus according to claim 1, wherein the transporting unit is configured to be demountably mounted with respect to the body frame along the transporting direction, and the urging member is configured to urge the opposing plate when the transporting unit is mounted in the body frame, and not to urge the opposing plate when the transporting unit is demounted from the body frame.

4. The image forming apparatus according to claim 3, wherein the urging member includes a metallic spring portion extending along directions in which the paper transporting unit is mounted and demounted with respect to the body frame and bent such that the metallic spring portion has an inverted V shape, and wherein the urging member is mounted to the opposing plate and is configured to abut with the body frame to ground the transporting unit.

5. The image forming apparatus according to claim 4, further comprising: a side guide grounding member mounted on the opposing plate and contacting with the side guide to have an electric connection with the side guide which is formed of a conductive material, the side guide grounding member extending along the directions of mounting and demounting and being mounted on the transporting tray, wherein the urging member is formed integrally with the side guide grounding member.

6. The image forming apparatus according to claim 1, further comprising:

a reversing unit configured to reverse the recording medium on which an image is formed by the image forming unit and to transport the reversed recording medium toward the transporting unit, wherein the transporting unit is configured to transport the recording medium reversed and transported by the reversing unit.

7. An image forming apparatus configured to transport a recording medium, comprising:

a body frame;

an image forming unit supported by the body frame and configured to form an image on the recording medium; and a transporting unit supported in the body frame and configured to transport the recording medium in a transporting direction, the transporting unit including:

a transporting tray configured to support the recording medium which is being transported;

a side guide disposed at an end portion of the transporting tray in a width direction perpendicular to the transporting direction and configured to abut with an end of the recording medium in the width direction;

a plate facing the transporting tray;

a skew roller rotatably supported by the plate and configured to skew the recording medium toward the side guide such that the skewed recording medium abuts with the side guide; and an urging member configured to urge a portion of the plate toward the transporting tray.

8. The image forming apparatus according to claim 7, wherein the transporting unit is configured to be demountably mounted with respect to the body frame along the transporting direction, and the urging member is configured to urge the opposing plate when the transporting unit is mounted in the body frame, and not to urge the opposing plate when the transporting unit is demounted from the body frame.

9. The image forming apparatus according to claim 8, wherein the urging member is mounted to the plate and is configured to abut with the body frame to ground the transporting unit.

10. The image forming apparatus according to claim 7, wherein the urging member is made of conductive metal and configured to contact the body frame and the side guide.

11. The image forming apparatus according to claim 7, further comprising a reversing unit configured to reverse the recording medium on which an image is formed by the image forming unit and to transport the reversed recording medium toward the transporting unit, wherein the transporting unit is configured to transport the recording medium reversed and transported by the reversing unit.

* * * * *